US011754087B2

(12) United States Patent
Kim et al.

(10) Patent No.: US 11,754,087 B2
(45) Date of Patent: Sep. 12, 2023

(54) OIL DISPERSION SYSTEM USING ACTUATOR FOR PROPELLERS

(71) Applicants: Hyundai Motor Company, Seoul (KR); Kia Corporation, Seoul (KR)

(72) Inventors: Gwi Taek Kim, Chungcheongnam-do (KR); Hyun Woo Jun, Seoul (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/479,545

(22) Filed: Sep. 20, 2021

(65) Prior Publication Data

US 2022/0364572 A1 Nov. 17, 2022

(30) Foreign Application Priority Data

May 11, 2021 (KR) ..... 10-2021-0060932

(51) Int. Cl.
*F04D 29/063* (2006.01)
*F04B 1/146* (2020.01)

(52) U.S. Cl.
CPC ..... *F04D 29/063* (2013.01); *F04B 1/146* (2013.01)

(58) Field of Classification Search
CPC ..... F04D 29/063; F04B 1/146; F04B 1/295; F04B 1/14; F04B 1/12; F04B 1/26; B64C 25/22; B64C 13/40; B64D 27/24; B64D 35/00; B64D 47/00
See application file for complete search history.

(56) References Cited

U.S. PATENT DOCUMENTS 1,842,569 A * 1/1932 Richer ..... F04B 1/146 91/507
1,935,921 A * 11/1933 Schwitzer ..... F04D 29/063 384/393
2,381,056 A * 8/1945 Huber ..... F04B 1/124 417/269
2,385,990 A * 10/1945 Huber ..... F04B 1/145 417/269
3,663,122 A * 5/1972 Kitchen ..... F04B 1/14 91/472

(Continued)

FOREIGN PATENT DOCUMENTS

CN 104775901 A 7/2015
CN 112901438 A 6/2021

(Continued)

OTHER PUBLICATIONS

JP_2003232277_A_| English Machine Translation (Year 2003).

(Continued)

*Primary Examiner* — J. Todd Newton
*Assistant Examiner* — Wayne A Lambert
(74) *Attorney, Agent, or Firm* — Fox Rothschild LLP

(57) ABSTRACT

An oil dispersion system uses an actuator for propellers and includes a pumping device that circulates oil when a driving motor is operated to drive a propeller, whereby the propeller and an oil circulation structure are integrated, and a circulation amount of oil is adjusted based on an angle of a swash plate of the pumping device when the driving motor is operated in order to drive the propeller, thereby controlling a supply of oil to no more than that required by oil-using parts.

9 Claims, 7 Drawing Sheets

(56) References Cited

U.S. PATENT DOCUMENTS

| | | | | |
|---|---|---|---|---|
| 3,806,066 | A * | 4/1974 | Eickmann | B64C 27/12 244/17.23 |
| 4,729,717 | A | 3/1988 | Gupta | |
| 4,738,589 | A * | 4/1988 | Wright | F01D 7/00 416/129 |
| 4,784,045 | A | 11/1988 | Terauchi | |
| 4,838,765 | A * | 6/1989 | Wusthof | F04B 1/18 417/269 |
| 5,220,225 | A | 6/1993 | Moon, Jr. | |
| 5,591,013 | A * | 1/1997 | Kawafune | F04B 1/20 417/271 |
| 5,877,577 | A | 3/1999 | Ishizaki et al. | |
| 5,927,073 | A | 7/1999 | Ishizaki et al. | |
| 6,254,357 | B1 * | 7/2001 | Lynn | F04B 49/007 417/539 |
| 6,565,329 | B2 | 5/2003 | Yokomachi et al. | |
| 6,792,844 | B1 | 9/2004 | Gedge et al. | |
| 7,014,428 | B2 | 3/2006 | Pitla et al. | |
| 7,168,997 | B2 * | 1/2007 | Ohtsuki | B63H 23/08 440/5 |
| 7,182,583 | B2 | 2/2007 | Gandrud et al. | |
| 8,358,042 | B2 | 1/2013 | Yamada et al. | |
| 9,000,602 | B2 | 4/2015 | Yamada et al. | |
| 9,991,764 | B2 | 6/2018 | Kim | |
| 10,465,679 | B2 * | 11/2019 | Hansen | F04B 53/08 |
| 2001/0048251 | A1 | 12/2001 | Ieoka | |
| 2003/0068239 | A1 | 4/2003 | Suzuki | |
| 2007/0053780 | A1 | 3/2007 | Ruffner et al. | |
| 2015/0064030 | A1 | 3/2015 | Suzuki et al. | |
| 2018/0346132 | A1 | 12/2018 | Casado-Montero et al. | |
| 2020/0149430 | A1 | 5/2020 | Cornet et al. | |
| 2022/0275800 | A1 | 9/2022 | Bauer | |

FOREIGN PATENT DOCUMENTS

| | | | |
|---|---|---|---|
| DE | 102007058534 | A1 | 6/2009 |
| EP | 0256389 | A2 | 2/1988 |
| EP | 2607696 | A1 | 6/2013 |
| EP | 2848808 | A1 | 3/2015 |
| GB | 2524787 | A | 10/2015 |
| JP | 2003232277 | A | 8/2003 |
| JP | 4322456 | B2 | 9/2009 |
| JP | 2009209725 | A | 9/2009 |
| JP | 2021124061 | A | 8/2021 |
| KR | 20120061767 | A | 6/2012 |
| KR | 101501134 | B1 | 3/2015 |
| KR | 20200072595 | A | 6/2020 |

OTHER PUBLICATIONS

KR_20200072595_A_| English Machine Translation (Year 2020).
Office Action dated Dec. 27, 2022 in corresponding U.S. Appl. No. 17/880,178.
Notice of Allowance dated Jun. 29, 2023 in U.S. Appl. No. 17/880,178.

* cited by examiner

OIL DISPERSION SYSTEM USING ACTUATOR FOR PROPELLERS

CROSS-REFERENCE TO RELATED APPLICATION

This application claims under 35 U.S.C. § 119(a) the benefit of Korean Patent Application No. 10-2021-0060932, filed on May 11, 2021 with the Korean Intellectual Property Office, the entire contents of which are incorporated by reference herein.

BACKGROUND

1. Technical Field

The present disclosure relates to an oil dispersion system using an actuator for propellers in which a driving system configured to rotate a propeller and a lubrication system configured to circulate oil are integrated.

2. Description of the Related Art

In recent years, air mobility has been subject of research and development, and may be usable in various fields, such as freight carrying and medical transport, and air mobility is expected to progress to a commercialization stage due to high energy efficiency and stabilization thereof.

An air mobility vehicle flies based on operation of a propeller, and is provided with an oil circulation device necessary to operate additional devices. That is, the oil circulation device is configured to generate hydraulic pressure using electrical or mechanical power supplied thereto and to supply the hydraulic pressure to additional devices that require hydraulic pressure. To this end, the oil circulation device must include an oil pump configured to pump oil. In addition, the oil circulation device must be operated in order to cool a drying system configured to rotate the propeller.

Conventionally, the driving system configured to rotate the propeller is provided separately from a lubrication system configured to perform cooling and lubrication and to supply oil necessary for the additional devices. As a result, installation spaces for the driving system and the lubrication system are separately required, whereby a lubrication line is complicated.

The matters disclosed in this section are merely for enhancement of understanding of the general background of the disclosure and should not be taken as an acknowledgment or any form of suggestion that the matters form the related art already known to a person skilled in the art.

SUMMARY

The present disclosure provides an oil dispersion system using an actuator for propellers in which a driving system configured to rotate a propeller and a lubrication system configured to circulate oil are integrated, thereby reducing an overall layout of the oil dispersion system and simplifying a structure of the oil dispersion system.

In accordance with an aspect of the present disclosure, the above and other objects can be accomplished by the provision of an oil dispersion system using an actuator for propellers, the oil dispersion system including a driving motor provided in a propeller housing, a shaft configured to be rotated by operation of the driving motor, a propeller connected to the shaft via a clutch device, and a pumping device including a swash plate installed at the shaft in an inclined state, the inclination angle of the swash plate being adjustable, and a piston configured to pump oil while being reciprocated by the swash plate that is rotated with the shaft.

The propeller housing may be partitioned into a first space, in which the clutch device is provided, a second space, in which the pumping device is provided, the second space being connected to the first space such that oil is circulated, and a third space, in which the driving motor is provided, the third space being connected to the second space such that the oil is circulated.

The propeller housing may be further provided with a fourth space, which is partitioned from the third space, which exchanges heat with the third space, and in which an electronic device is provided, the electronic device being cooled through heat exchange between oil that flows through the third space and the electronic device.

The clutch device, an external heat exchanger, one or more oil-using parts, and the driving motor may be included in an oil circulation channel formed by the pumping device.

The oil dispersion system may further include a controller configured to determine required power of the propeller and a required use amount of oil and to control engagement and disengagement of the clutch device and the inclination angle of the swash plate based on the required power of the propeller and the required use amount of oil.

In the case in which the required power of the propeller is generated, the controller may perform control such that the clutch device is engaged, and, in the case in which no required power of the propeller is generated, the controller may perform control such that the clutch device is disengaged.

In the case in which the required power of the propeller is generated and the use of oil is required by the oil-using parts, the controller may perform control such that the driving motor is operated by the required power of the propeller and the swash plate is inclined to the maximum angle.

In the case in which the required power of the propeller is generated and the use of oil is required by some of the oil-using parts or no use of oil is required by the oil-using parts, the controller may derive the use amount of oil required by each of the oil-using parts and may derive the inclination angle of the swash plate satisfying the required use amount of oil at a rotational speed of the shaft as the result of operation of the driving motor by the required power of the propeller, thereby controlling the inclination angle of the swash plate.

In the case in which no required power of the propeller is generated and the use of oil by the oil-using parts is required, the controller may perform control such that the swash plate is inclined to the maximum angle and may control operation of the driving motor based on the use amount of oil required by each of the oil-using parts.

In the case in which no required power of the propeller is generated and the use of oil by the oil-using parts is required, the controller may perform control such that the driving motor is operated at a value set for oil circulation and may control the inclination angle of the swash plate based on the use amount of oil required by each of the oil-using parts.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION OF THE PREFERRED EMBODIMENTS

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, preferred embodiments of an oil dispersion system using an actuator for propellers according to the present disclosure will be described in detail with reference to the accompanying drawings.

Figure 1:
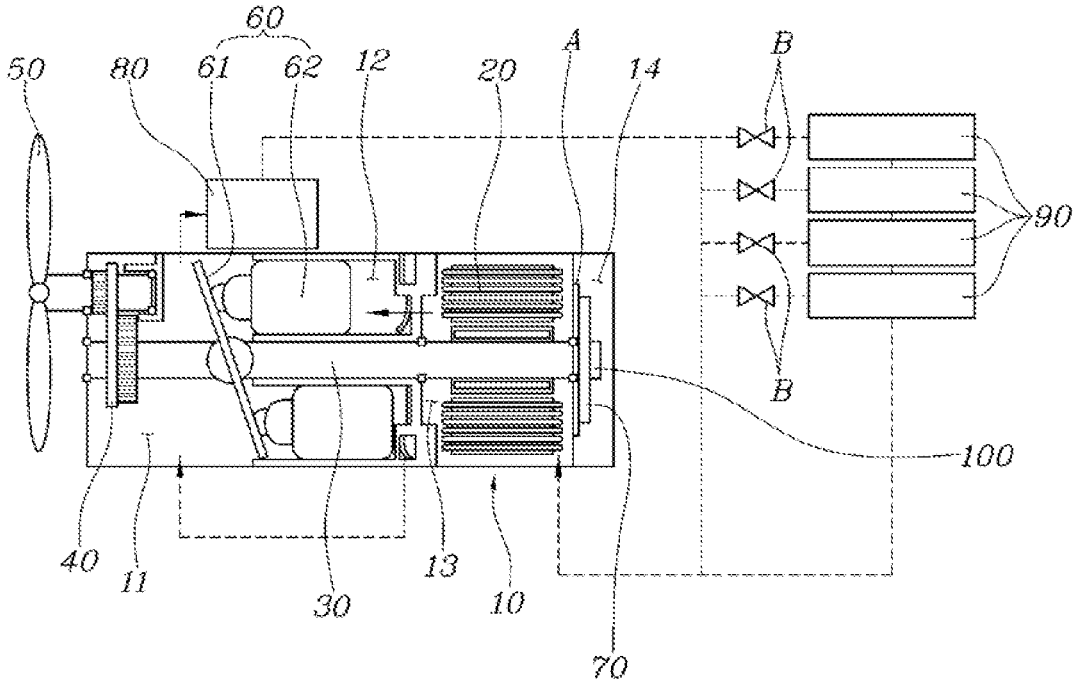
FIG. 1 is a view showing an oil dispersion system using an actuator for propellers according to the present disclosure.
Figure 2:
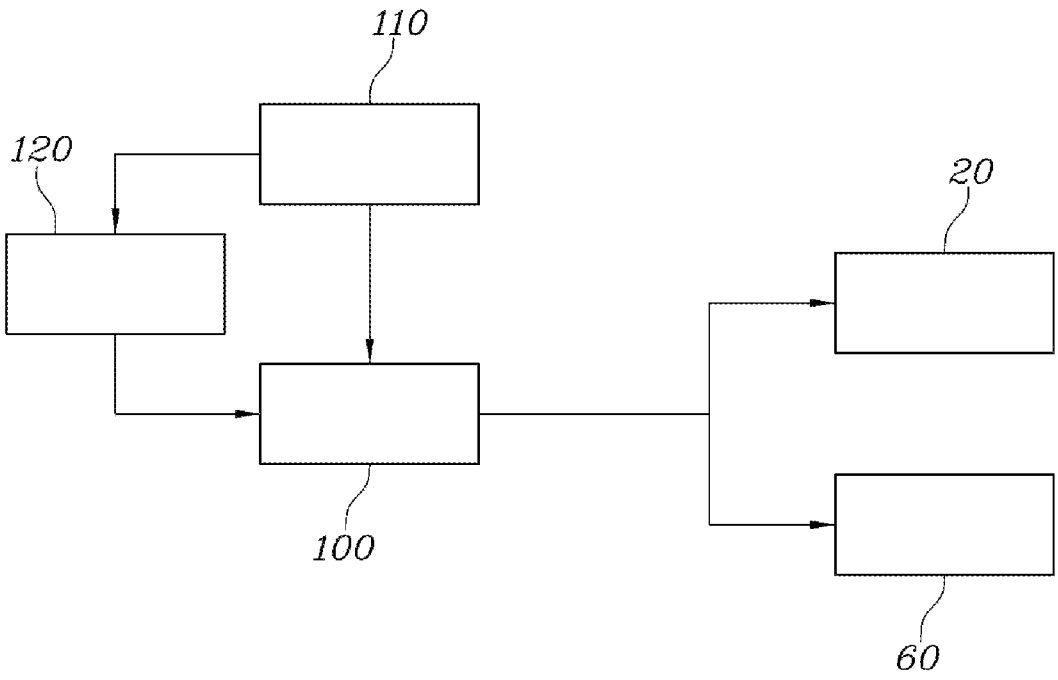
FIG. 2 is a view showing the construction of the oil dispersion system using the actuator for propellers according to the present disclosure.
Figure 3:
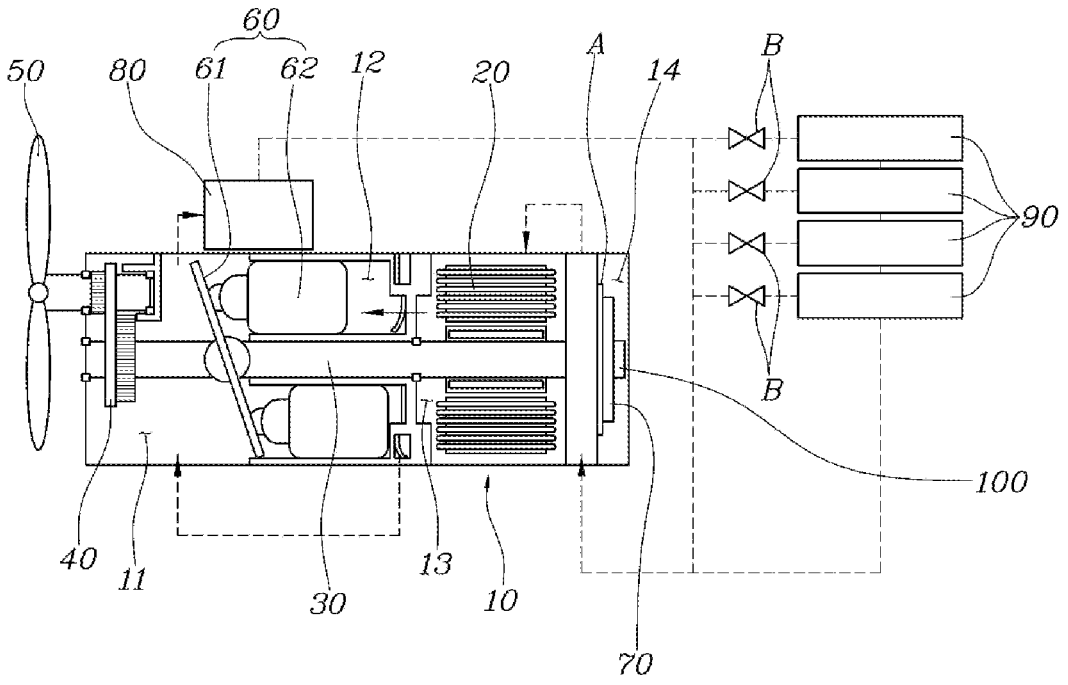
FIG. 3 is a view illustrating another embodiment of the oil dispersion system using the actuator for propellers according to the present disclosure.

FIG. 1 is a view showing an oil dispersion system using an actuator for propellers according to the present disclosure, FIG. 2 is a view showing the construction of the oil dispersion system using the actuator for propellers according to the present disclosure, FIG. 3 is a view illustrating another embodiment of the oil dispersion system using the actuator for propellers according to the present disclosure, and FIGS. 4 to 7 are views showing operation examples of the oil dispersion system using the actuator for propellers according to the present disclosure.

As shown in FIGS. 1 and 2, an oil dispersion system using an actuator for propellers according to the present disclosure includes a driving motor 20 provided in a propeller housing 10, a shaft 30 configured to be rotated by operation of the driving motor 20, a propeller 50 connected to the shaft 30 via a clutch device 40, a pumping device 60 including a swash plate 61 installed at the shaft 30 in an inclined state, the inclination angle of the swash plate being adjustable, and a piston 62 configured to pump oil while being reciprocated by the swash plate 61 that is rotated with the shaft 30.

Here, the propeller housing 10 may be installed at a body or a wing of an air mobility vehicle. When the propeller 50 is rotated in the propeller housing 10, thrust may be generated, whereby the air mobility vehicle may fly.

The driving motor 20 is provided in the propeller housing 10. When the driving motor 20 is operated, the shaft 30 is rotated, whereby the propeller 50 is rotated. Here, the propeller 50 is connected to the shaft 30 via the clutch device 40. When the clutch device 40 is engaged, the propeller 50 is rotated by rotation of the shaft 30. When the clutch device 40 is disengaged, the propeller 50 is not rotated even though the shaft 30 is rotated. The clutch device 40 includes a speed reducer. When the shaft 30 is rotated by operation of the driving motor 20, therefore, the propeller 50 may be rotated at an appropriate rotation speed.

Meanwhile, the pumping device 60 is connected to the shaft 30 in addition to the propeller 50. When the shaft 30 is rotated, therefore, the propeller 50 and the pumping device 60 are rotated together. In particular, the pumping device 60 includes a swash plate 61 installed at the shaft 30 in an inclined state, the inclination angle of the swash plate being adjustable, and a piston 62 configured to pump oil while being reciprocated by the swash plate 61 that is rotated with the shaft 30. That is, when the driving motor 20 is operated to rotate the shaft 30, the swash plate 61 is rotated with the shaft 30. The swash plate 61 is installed at the shaft 30 so as to be inclined. When the swash plate 61 is rotated with the shaft 30, therefore, the piston 62 connected to the swash plate 61 is reciprocated to pump oil.

Also, in the present disclosure, the swash plate 61 is installed such that the inclination angle thereof is adjustable. In the case in which the inclination angle of the swash plate 61 is increased, the stroke of the piston 62 is increased, and therefore the circulation amount of oil is increased. In the case in which the inclination angle of the swash plate 61 is decreased, the stroke of the piston 62 is decreased, and therefore the circulation amount of oil is decreased.

In the present disclosure, therefore, when the air mobility vehicle flies, the shaft 30 rotated by operation of the driving motor 20 rotates the propeller 50, and at the same time the swash plate 61 of the pumping device 60 is rotated with the shaft 30, whereby the piston 62 is reciprocated to circulate oil.

In the present disclosure, as described above, when the driving motor 20 is operated, rotation of the propeller 50 and oil circulation by the pumping device 60 are simultaneously performed.

Hereinafter, the present disclosure will be described in detail. As shown in FIG. 1, the propeller housing 10 is partitioned into a first space 11, in which the clutch device 40 is provided, a second space 12, in which the pumping device 60 is provided, the second space being connected to the first space 11 such that oil is circulated, and a third space 13, in which the driving motor 20 is provided, the third space being connected to the second space 12 such that the oil is circulated.

As described above, the propeller housing 10 is partitioned into the first space 11, the second space 12, and the third space 13, and oil is circulated through the respective spaces. To this end, each of the first space 11, the second space 12, and the third space 13 is provided with an inlet and an outlet, through which oil flows. In the second space 12, the pumping device 60 is provided such that oil is circulated through the respective spaces by operation of the pumping device 60. Here, a valve is provided in each of the inlet and the outlet of the second space 12 such that oil is smoothly circulated by operation of the pumping device 60.

That is, when the pumping device 60 is operated in the propeller housing 10, oil flows from the second space 12 to the first space 11 so as to be supplied to the clutch device 40 of the propeller 50, flows through various parts provided outside the propeller housing 10 from the first space 11, flows to the third space 13 to cool the driving motor 20 provided in the third space 13, and flows to the second space 12, which is an oil circulation structure.

In addition, the propeller housing 10 is further provided with a fourth space 14, which is partitioned from the third space 13 and in which an electronic device 70 configured to perform heat exchange with the third space 13 is provided. The electronic device 70 is cooled through heat exchange between oil that flows through the third space 13 and the electronic device 70.

Here, the fourth space 14 is configured to perform heat exchange with the third space 13, although no oil flows through the fourth space. To this end, a heat conductive member A made of a material that exhibits high thermal conductivity may be provided between the third space 13 and the fourth space 14, and the electronic device 70 may be installed in the fourth space 14 so as to abut the heat conductive member A. Consequently, the electronic device 70 may be smoothly cooled as the result of heat exchange with oil in the third space 13.

In another embodiment, as shown in FIG. 3, the fourth space 14 may be configured to be separated from the third space 13, an oil flow channel to the fourth space 14 may be formed, and the electronic device 70 may exchange heat with oil in the oil flow channel via the heat conductive member A, whereby the electronic device 70 may be cooled.

Meanwhile, when describing the present disclosure in detail, the clutch device 40, an external heat exchanger 80, one or more oil-using parts 90, and the driving motor 20 are included in an oil circulation channel formed by the pumping device 60.

Here, oil that is circulated in the propeller housing 10 is configured to flow through the external heat exchanger 80 and to exchange heat with external air outside the propeller housing 10 in order to cool the oil.

The oil-using parts 90, which are devices configured to be driven by hydraulic pressure in the air mobility vehicle, include landing gear and a wing angle adjuster.

The electronic device 70 includes a controller 100 configured to control the driving motor 20, and an inverter may be included in the electronic device 70.

That is, as can be seen from FIG. 1, oil may be sequentially circulated through the clutch device 40 in the first space 11 of the propeller housing 10, the external heat exchanger 80, the oil-using parts 90, the driving motor 20 in the third space 13, and the pumping device 60 in the second space 12 by the pumping device 60. Here, the positions of the external heat exchanger 80 and the oil-using parts 90 may be changed. A check valve B configured to selectively allow oil to flow to the oil-using parts 90 therethrough may be provided in the oil circulation channel formed by the pumping device 60.

Consequently, oil flows to the first space 11 as the result of operation of the pumping device 60 to cool and lubricate the clutch device 40, is cooled by the external heat exchanger 80, and is supplied to the oil-using parts 90 such that operation through hydraulic pressure is performed. Meanwhile, the oil that has passed through the oil-using parts 90 cools and lubricates the driving motor 20 in the third space 13, since the oil was cooled by the external heat exchanger 80, and flows to the second space 12 at the result of operation of the pumping device 60 in the second space 12.

In the present disclosure, as described above, when the shaft 30 is rotated by operation of the driving motor 20, the pumping device 60 may be operated with rotation of the propeller 50, whereby oil may be circulated.

Meanwhile, the oil dispersion system according to the present disclosure further includes a controller 100 configured to determine required power of the propeller 50 and a required use amount of oil and to control engagement and disengagement of the clutch device 40 and the inclination angle of the swash plate 61 based on the required power of the propeller 50 and the required use amount of oil.

The controller 100 may determine the required power of the propeller 50 based on the flight state of the air mobility vehicle and may determine the use amount of oil based on the temperature of the driving motor 20 or the amount of hydraulic pressure required by the oil-using parts 90.

That is, as shown in FIG. 2, the controller 100 receives user settings or information based on a control value of the air mobility vehicle set to a target from a flight controller 110 to determine the required power of the propeller 50. In addition, the controller 100 receives information based on the amount of oil required by the oil-using parts 90 from a hydraulic pressure controller 120 to determine the inclination angle of the swash plate 61, and corrects the inclination angle of the swash plate 61 based on rotational speed of the shaft 30 such that an appropriate amount of oil is circulated. As a result, the controller 100 controls the driving amount of the driving motor 20 and the inclination angle of the swash plate 61. Consequently, the driving motor 20 is operated by power received from a battery and the inclination angle of the swash plate 61 is adjusted, whereby oil is circulated.

As described above, the controller 100 controls the driving motor 20, the clutch device 40, and the swash plate 61 based on the required power of the propeller 50 and the required use amount of oil such that thrust is generated by the propeller 50 and oil is circulated.

Specifically, in the case in which the required power of the propeller 50 is generated, the controller 100 performs control such that the clutch device 40 is engaged, and, in the case in which no required power of the propeller 50 is generated, the controller 100 performs control such that the clutch device 40 is disengaged.

That is, in the situation in which the propeller 50 must be operated, the controller 100 performs control such that the clutch device 40 is engaged such that the propeller 50 is rotated by rotation of the shaft 30 due to operation of the driving motor 20. In the case in which the propeller 50 is not operated, on the other hand, the controller 100 performs control such that the clutch device 40 is disengaged such that the propeller 50 is not rotated by rotation of the shaft 30 even though the driving motor 20 is rotated for oil circulation.

Also, in the case in which the required power of the propeller 50 is generated and the use of oil is required by the oil-using parts 90, the controller 100 performs control such that the driving motor 20 is operated by the required power of the propeller 50 and the swash plate 61 is inclined to the maximum angle.

Figure 4:
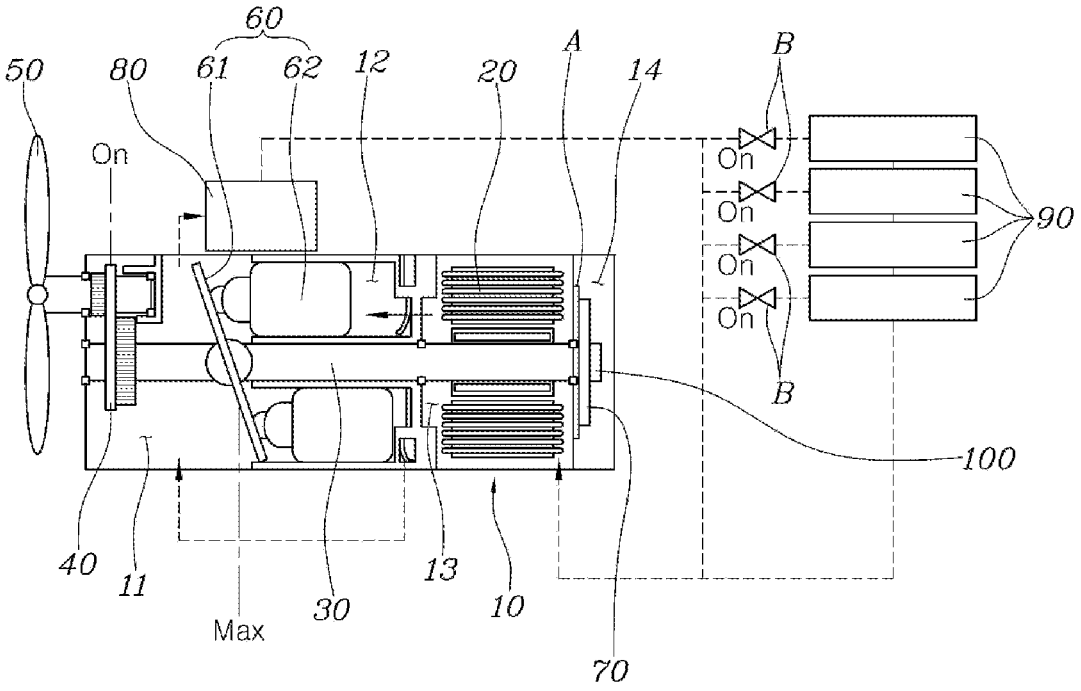
FIGS. 4 to 7 are views showing operation examples of the oil dispersion system using the actuator for propellers according to the present disclosure.

That is, as shown in FIG. 4, in the case in which the required power of the propeller 50 is generated, the controller 100 performs control such that the clutch device 40 is engaged and the driving motor 20 is operated by the required power of the propeller 50, whereby the propeller 50 is rotated by power of the driving motor 20. Also, in the case in which the use of oil is required by the oil-using parts 90, the controller 100 performs control such that the swash plate 61 is inclined to the maximum angle, whereby the swash plate 61 that is rotated with the shaft 30 operates the piston 62 at the maximum stroke, and therefore the circulation amount of oil is secured.

Consequently, the propeller 50 is rotated by operation of the driving motor 20, whereby normal thrust is generated and the circulation amount of oil by the pumping device 60 is secured, and therefore the amount of hydraulic pressure required by the oil-using parts 90 is satisfied. In addition, the amount of oil that is cooled through the external heat exchanger 80 is increased, whereby cooling operation, including cooling of the driving motor 20, is smoothly performed.

Meanwhile, in the case in which the required power of the propeller 50 is generated and the use of oil is required by some of the oil-using parts 90 or no use of oil is required by the oil-using parts 90, the controller 100 derives the use amount of oil required by each of the oil-using parts 90 and derives the inclination angle of the swash plate 61 satisfying the required use amount of oil at the rotational speed of the shaft 30 as the result of operation of the driving motor 20 by the required power of the propeller 50, thereby controlling the inclination angle of the swash plate 61.

Figure 5:
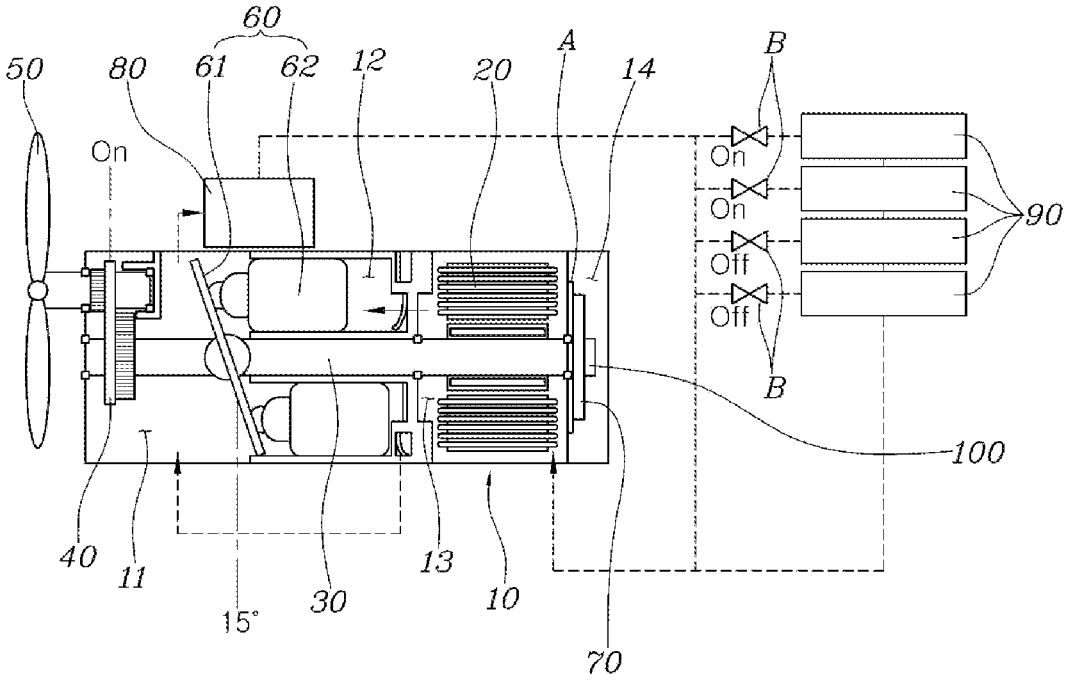

That is, as shown in FIG. 5, in the case in which the required power of the propeller 50 is generated, the controller 100 performs control such that the clutch device 40 is engaged and the driving motor 20 is operated by the required power of the propeller 50, whereby the propeller 50 is rotated by the power of the driving motor 20. However, in the case in which the inclination angle of the swash plate 61 is large in the state in which the use of oil is required by only some of the oil-using parts 90 or no use of oil is required by the oil-using parts 90, the driving motor 20 is operated in order to satisfy the required power of the propeller 50, whereby an excessive amount of oil is circulated. Consequently, the controller 100 derives the use amount of oil required by each of the oil-using parts 90.

As described above, the controller 100 derives the inclination angle of the swash plate 61 satisfying the required use amount of oil at the rotational speed of the shaft 30 as the result of operation of the driving motor 20 by the required power of the propeller 50, and controls the inclination angle of the swash plate 61 so as to be the derived inclination angle of the swash plate 61, whereby the propeller 50 is normally operated and an appropriate amount of oil is circulated by the pumping device 60, and therefore the oil-using parts 90 are normally operated.

Meanwhile, in the case in which no required power of the propeller 50 is generated and the use of oil by the oil-using parts 90 is required, the controller 100 performs control such that the swash plate 61 is inclined to the maximum angle and controls operation of the driving motor 20 based on the use amount of oil required by each of the oil-using parts 90.

Figure 6:
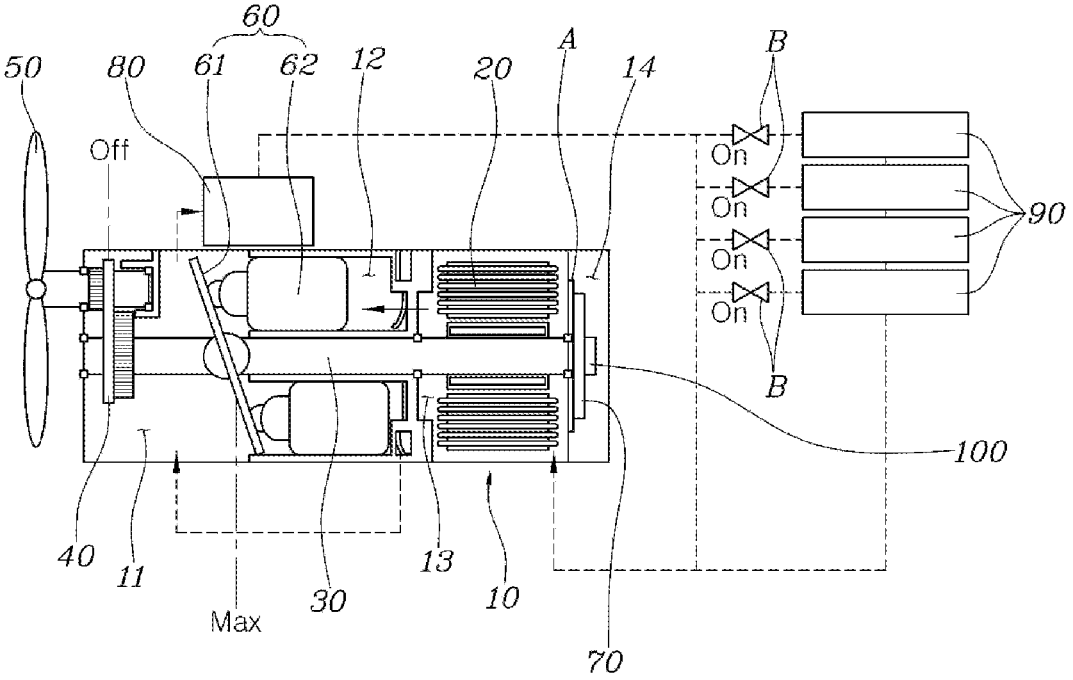

That is, as shown in FIG. 6, in the case in which no required power of the propeller 50 is generated, the controller 100 performs control such that the clutch device 40 is disengaged, whereby the propeller 50 is not rotated by power of the driving motor 20. Since the use of oil by the oil-using parts 90 is required, however, the driving motor 20 must be operated, and the controller 100 performs control such that the swash plate 61 is inclined to the maximum angle and controls operation of the driving motor 20 based on the use amount of oil required by each of the oil-using parts 90. Since the swash plate 61 is controlled so as to be inclined to the maximum angle, as described above, the swash plate 61 operates the piston 62 at the maximum stroke, whereby the circulation amount of oil is secured. In addition, since the swash plate 61 is disposed so as to be inclined to the maximum angle, the driving amount of the driving motor necessary to operate the pumping device 60 is reduced. The amount of oil that is required by the oil-using parts 90 may be satisfied by the controller 100 controlling the driving amount of the driving motor.

In another embodiment, in the case in which no required power of the propeller 50 is generated and the use of oil by the oil-using parts 90 is required, the controller 100 may perform control such that the driving motor 20 is operated at a value set for oil circulation and may control the inclination angle of the swash plate 61 based on the use amount of oil required by each of the oil-using parts 90.

Figure 7:
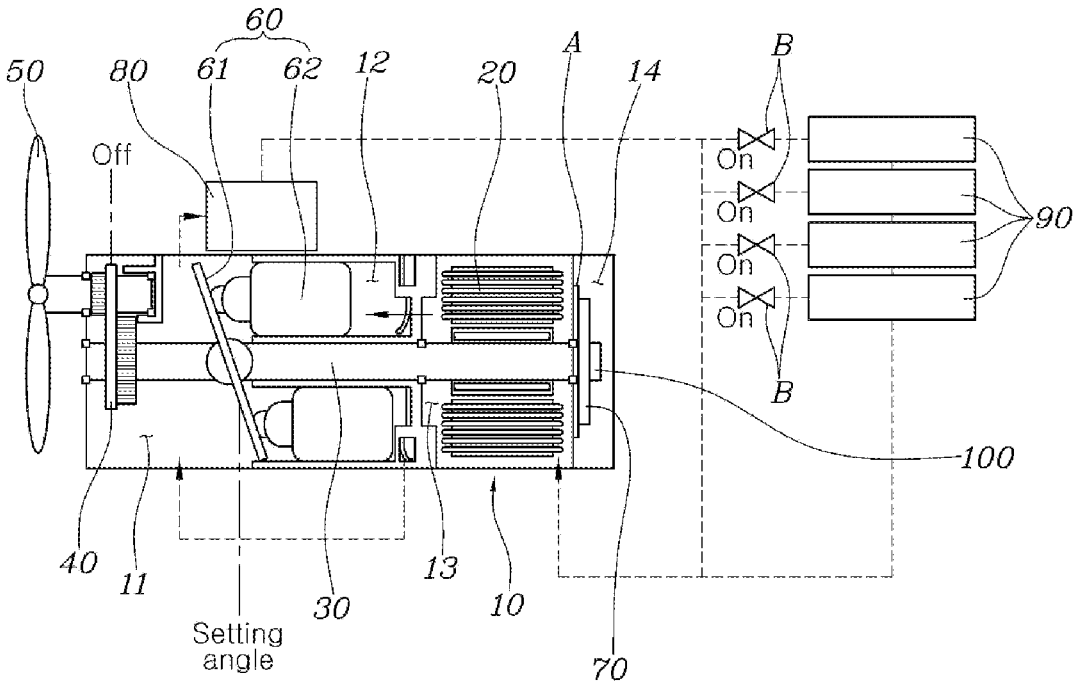

That is, as shown in FIG. 7, in the case in which no required power of the propeller 50 is generated, the controller 100 performs control such that the clutch device 40 is disengaged, whereby the propeller 50 is not rotated by power of the driving motor 20. Since the use of oil by the oil-using parts 90 is required, however, the driving motor 20 must be operated. Consequently, the controller 100 performs control such that the driving motor 20 is operated at a value set for oil circulation and controls the inclination angle of the swash plate 61 based on the use amount of oil required by each of the oil-using parts 90. Here, the value set for oil circulation pre-stored in the controller 100 may be set depending on the oil-using parts 90. In addition, the inclination angle of the swash plate 61 is controlled based on the use amount of oil required by each of the oil-using parts 90. In the state in which the driving motor 20 is operated at the value set for oil circulation, therefore, oil is supplied based on the required use amount of oil.

In the oil dispersion system using the actuator for propellers having the above structure, the pumping device 60 is also operated to circulate oil when the driving motor 20 is operated to drive the propeller 50. Consequently, the propeller 50 and the oil circulation structure are integrated, whereby the structure of the oil dispersion system is simplified.

As is apparent from the above description, the oil dispersion system using the actuator for propellers having the above structure is configured such that the pumping device is also operated to circulate oil when the driving motor is operated to drive the propeller. Consequently, the propeller and the oil circulation structure are integrated, whereby the structure of the oil dispersion system is simplified.

In addition, the circulation amount of oil is adjusted based on the angle of the swash plate of the pumping device when the driving motor is operated in order to drive the propeller, whereby supply of more oil than required by the oil-using parts is prevented.

Although the preferred embodiments of the present disclosure have been described above with reference to the accompanying drawings, those skilled in the art will appreciate that the present disclosure can be implemented in various other embodiments without changing the technical ideas or features thereof.

What is claimed is:

1. An oil dispersion system using an actuator for propellers, the oil dispersion system comprising:

a driving motor provided in a propeller housing;

a shaft configured to be rotated by operation of the driving motor;

a propeller connected to the shaft via a clutch device; and a pumping device comprising a swash plate installed at the shaft in an inclined state, an inclination angle of the swash plate being adjustable, and a piston configured to pump oil while being reciprocated by the swash plate that is rotated with the shaft;

wherein the clutch device, an external heat exchanger, one or more oil-using parts, and the driving motor are included in an oil circulation channel formed by the pumping device.

2. The oil dispersion system according to claim 1, wherein the propeller housing is partitioned into a first space, in which the clutch device is provided, a second space, in which the pumping device is provided, the second space being connected to the first space such that oil is circulated, and a third space, in which the driving motor is provided, the third space being connected to the second space such that the oil is circulated.

3. The oil dispersion system according to claim 2, wherein the propeller housing is further provided with a fourth space, which is partitioned from the third space, which exchanges heat with the third space, and in which an electronic device is provided, the electronic device being cooled through heat exchange between oil that flows through the third space and the electronic device.

4. The oil dispersion system according to claim 1, further comprising a controller configured to determine required power of the propeller and a required use amount of oil and to control engagement and disengagement of the clutch device and the inclination angle of the swash plate based on the required power of the propeller and the required use amount of oil.

5. The oil dispersion system according to claim 4, wherein:

in a case in which the required power of the propeller is generated, the controller performs control such that the clutch device is engaged, and in a case in which no required power of the propeller is generated, the controller performs control such that the clutch device is disengaged.

6. The oil dispersion system according to claim 4, wherein in a case in which the required power of the propeller is generated and use of oil is required by the oil-using parts, the controller performs control such that the driving motor is operated by the required power of the propeller and the swash plate is inclined to a maximum angle.

7. The oil dispersion system according to claim 4, wherein in a case in which the required power of the propeller is generated and use of oil is required by some of the oil-using parts or no use of oil is required by the oil-using parts, the controller derives a use amount of oil required by each of the oil-using parts and derives the inclination angle of the swash plate satisfying the required use amount of oil at a rotational speed of the shaft as a result of operation of the driving motor by the required power of the propeller, thereby controlling the inclination angle of the swash plate.

8. The oil dispersion system according to claim 4, wherein, in a case in which no required power of the propeller is generated and use of oil by the oil-using parts is required, the controller performs control such that the swash plate is inclined to a maximum angle and controls operation of the driving motor based on a use amount of oil required by each of the oil-using parts.

9. The oil dispersion system according to claim 4, wherein, in a case in which no required power of the propeller is generated and use of oil by the oil-using parts is required, the controller performs control such that the driving motor is operated at a value set for oil circulation and controls the inclination angle of the swash plate based on a use amount of oil required by each of the oil-using parts.

* * * * *